United States Patent [19]

Sideri

[11] 4,445,622

[45] May 1, 1984

[54] SELF-LOCKING PILFER PROOF CONTAINER

[76] Inventor: Leonardo Sideri, 47 East 44th St., New York, N.Y. 10017

[21] Appl. No.: 396,722

[22] Filed: Jul. 9, 1982

[51] Int. Cl.[3] ..... B65D 41/16; B65D 41/18

[52] U.S. Cl. ..... 220/306; 206/469; 206/806

[58] Field of Search ..... 220/306, 307; 206/469, 206/806

[56] References Cited

U.S. PATENT DOCUMENTS 579,560 3/1897 Caillet ..... 220/307

FOREIGN PATENT DOCUMENTS 2460855 7/1979 France ..... 220/306

2017049 9/1979 United Kingdom ..... 206/806

*Primary Examiner*—George T. Hall

*Attorney, Agent, or Firm*—Fitzpatrick, Cella, Harper & Scinto

[57] ABSTRACT

A self-locking container comprises two walled panels, the respective walls being constructed to interlock when brought together to close the container in a manner whereby the container must be destroyed to gain access to its contents.

9 Claims, 7 Drawing Figures

Fig. 1.
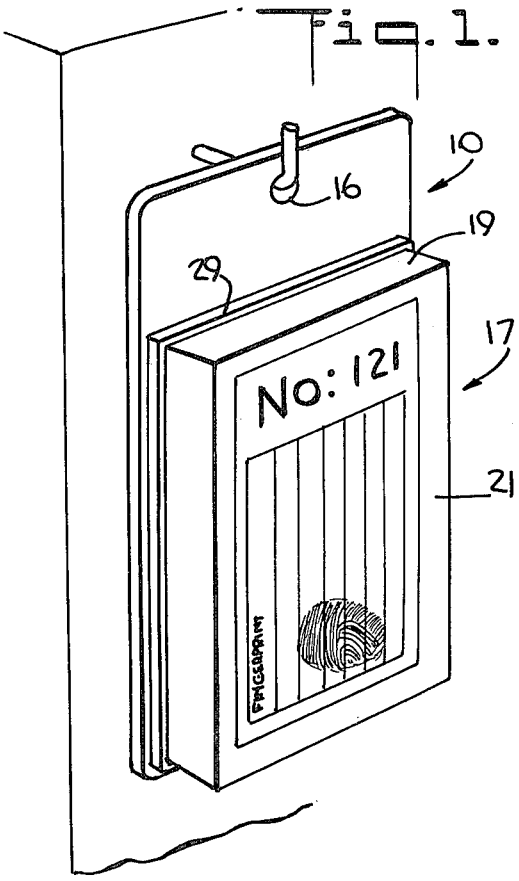
Fig. 4.
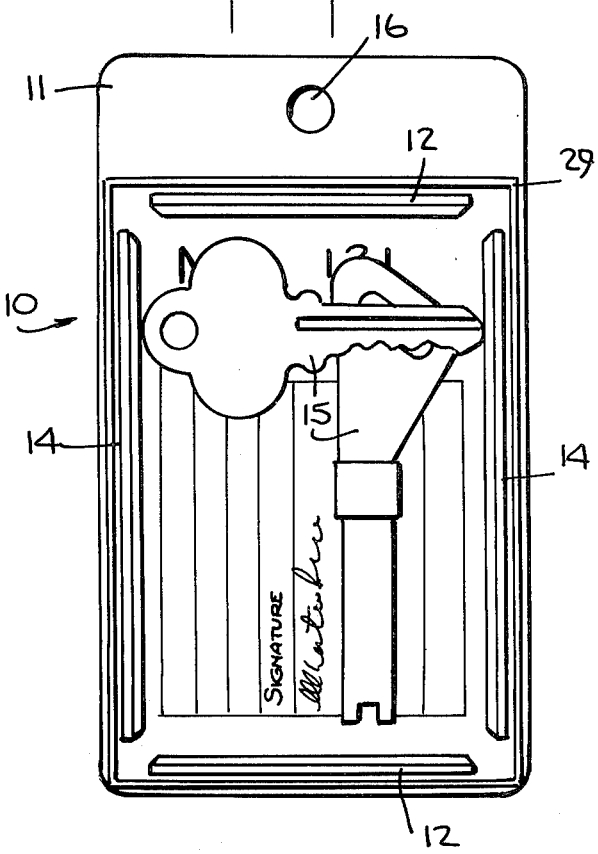
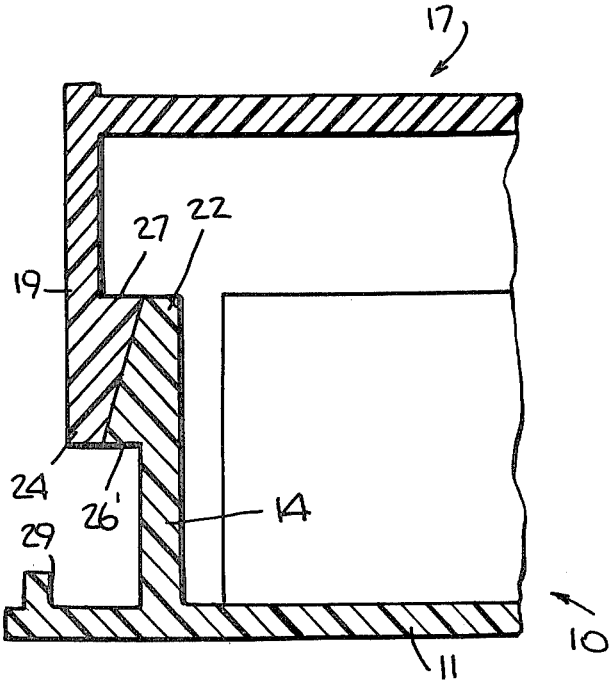
Fig. 5.
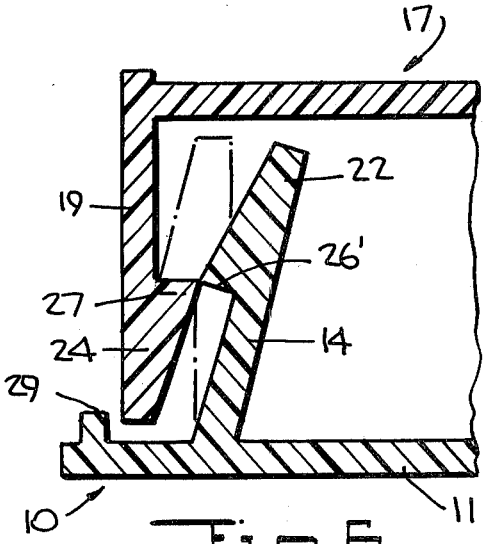
Fig. 6.

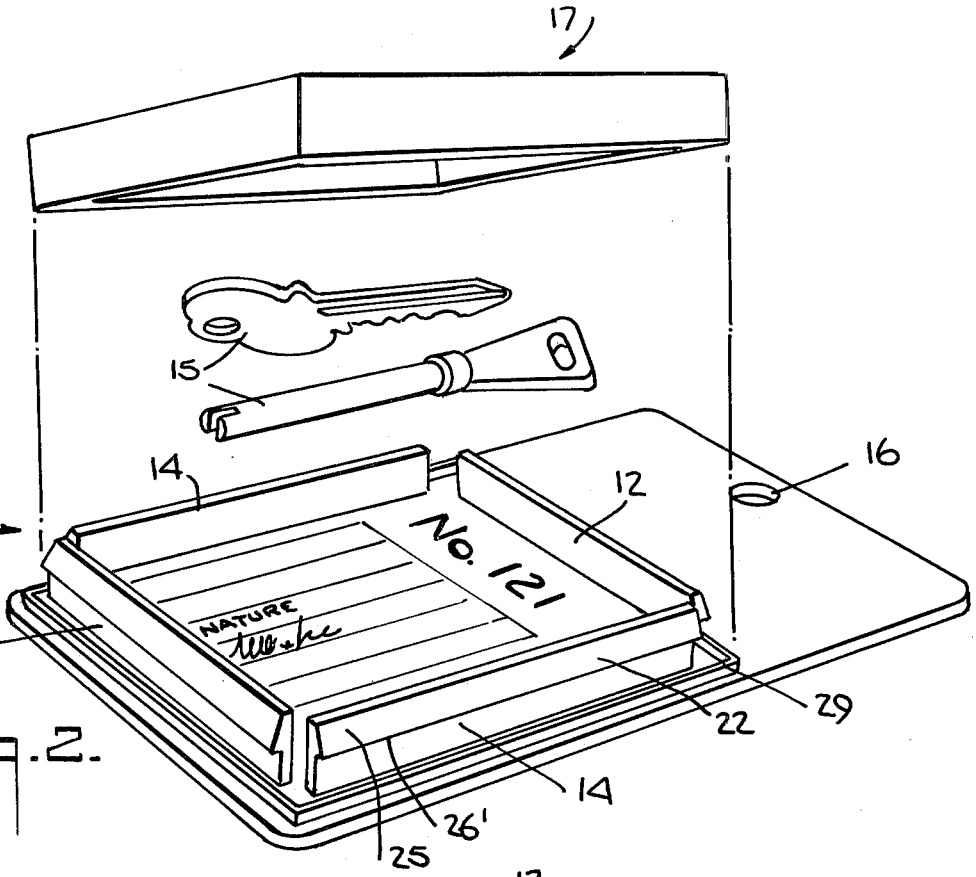
Fig. 2.
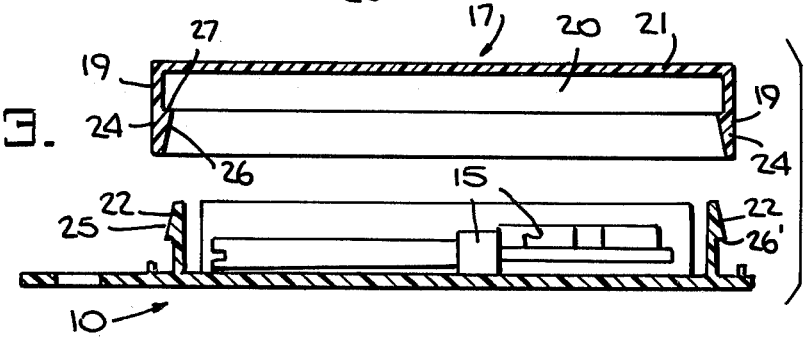
Fig. 3.
Fig. 7.
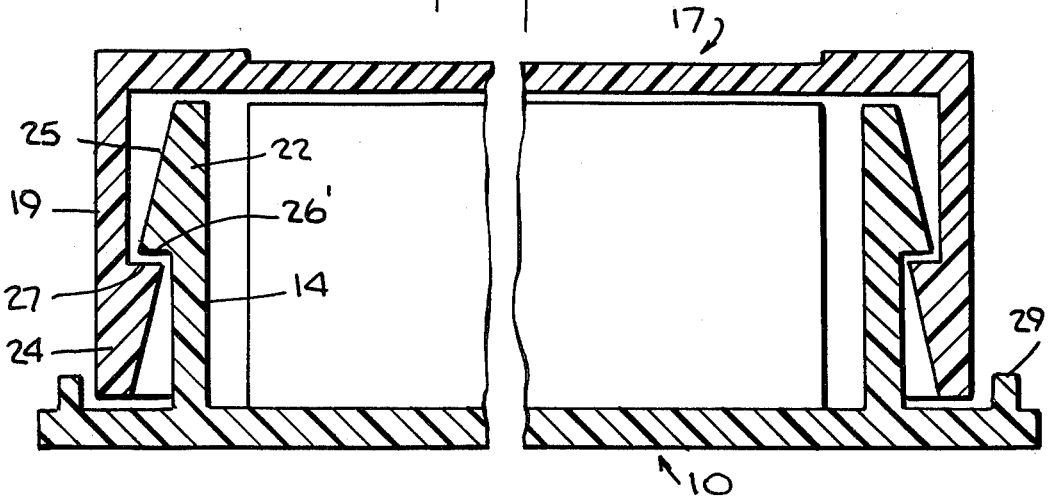

SELF-LOCKING PILFER PROOF CONTAINER

BACKGROUND OF THE INVENTION

1. Field of the Invention

This invention relates to containers, and more particularly to self-locking containers which, once closed, cannot be opened without giving a visual indication of that fact.

Containers of the type here contemplated find a wide variety of applications. For example, in many jurisdictions, apartment dwellers or lessees are required to provide the landlord a key to their premises. These keys are often stored in readily available locations and tagged to identify the premises to which they provide access. Many tenants are uncomfortable with this requirement since they cannot know when or for what reason their premises have been entered, unless specifically advised. Thus, there is a need for a key storage system which will enable a tenant to know that access has been had to his key, and thus his premises; and, at the same time to store the key in a manner which will limit identification of the premises to which the key provides access.

2. Description of the Prior Art

A number of self-locking cartons or the like are known which are fabricated at least partially from cardboard or paperboard, as disclosed, for example, in U.S. Pat. Nos. 2,834,531 and 3,025,958. Containers of this type may be opened by cutting with a sharp, thin blade along a crease or corner and then reclosing them with a transparent adhesive or the like to prevent or delay detection of tampering.

Other containers employ a tear sheet to expose adhesive surfaces, as taught in U.S. Pat. No. 3,144,935 to gain access to the container contents, such containers being resealable, while U.S. Pat. No. 3,896,965 is directed to a tamper indicator tape for a hermetically sealed container, the tape being removable and changing color when flexed to indicate that the container has been tampered with. U.S. Pat. No. 4,197,940 discloses a transparent container cover which becomes opaque when flexed.

Additional patents of interest are U.S. Pat. Nos. 655,894, 2,734,624, 3,367,488, 3,527,400, 3,835,995, 3,924,746 and 3,949,931.

SUMMARY OF THE INVENTION

I have conceived and contribute by the present invention a self-locking container by which I am able to obviate the foregoing disadvantages. Thus, my self-locking container, while simple and inexpensive to manufacture, must be totally destroyed, once closed, to obtain access to its contents.

To attain the objectives mentioned above, and to be later expressed, a principle feature of my invention resides in a self-locking container comprising a first panel including side wall means extending from a surface thereof and provided with a tab defining cam means and a locking surface, a second panel including wall means extending from a surface thereof and provided with a tab defining cam means and a locking surface. The sidewall means and the wall means are adapted to be telescopically disposed relative to one another to close the container, the cam means of the first and second panel tabs engaging one another during the telescoping movement resiliently to flex at least one of the sidewall means and the wall means away from the other, the locking surfaces assuming a condition of mutual engagement to lock the panels against separation upon completion of the telescoping movement.

According to another aspect of the invention, I prefer to form at least one of the sidewall means and the wall means of a semi-rigid material, although both of them may be thus formed, to provide the resilient flexing that permits the camming and locking action mentioned above. More specifically, I have found that both panels may be formed of high-impact polystyrene which may readily be injection molded, is highly resistant to destructive forces and yet provides the necessary degree of resilient flexing.

The cam means may take the form of inclined surfaces formed on the respective tabs for mutual engagement during the telescoping movement to flex at least one of the sidewall means or the wall means away from the other and the locking surfaces may be perpendicular to the plane of the sidewall means and wall means when in locking condition.

The panels may be molded as separate pieces or they may be molded to provide a thin joining section along an axis therebetween to afford a hinge to bring the tabs into cooperative disposition upon relative movement of the panels to close the container.

When the container is closed, the sidewall means of the first panel is disposed within the confines of the wall means of the second panel and the first panel is formed with an upstanding lip that overlaps the distal end of the wall means of the second panel, for a purpose later to be described.

For identification purposes, I provide at least one of the panels with an external surface area adapted to receive indicia thereon.

There has thus been outlined rather broadly the more important features of the invention in order that the detailed description thereof that follows may be better understood, and in order that the present contribution to the art may be better appreciated. There are, of course, additional features of the invention that will be described hereinafter and which will form the subject of the claims appended hereto. Those skilled in the art will appreciate that the conception upon which this disclosure is based may readily be utilized as a basis for designing of other structures for carrying out the several purposes of the invention. It is important, therefore, that the claims be regarded as including such equivalent constructions as do not depart from the spirit and scope of the invention.

BRIEF DESCRIPTION OF THE DRAWINGS

Specific embodiments of the invention have been chosen for purposes of illustration and description, and are shown in the accompanying drawings, forming a part of the specification wherein:

FIG. 1 is a perspective view of the device according to the present invention;

FIG. 2 is an exploded, perspective view of both panels positioned for closing and a pair of keys to be contained;

FIG. 3 is an exploded sectional view in cross-section illustrating structural elements of a device according to the present invention;

FIG. 4 is a an elevational view illustrating one of the panels for containing items to be secured;

FIG. 5 is a partial cross-sectional view illustrating the position of the respective tabs during commencement of closing movement of the panels;

FIG. 6 is a view similar to FIG. 5 but illustrating the tabs just prior to locking; and FIG. 7 is a cross-sectional view illustrating the device in closed, locked disposition.

Referring now to the drawings, and more particularly to FIGS. 1 to 4 there is shown a first panel 10 which includes a base 11 and two pairs of opposed side walls 12, 14, each pair being disposed at 90° to the other pair to define an enclosure open at the corners and upstanding from the base 11 for receiving the item or items, such as keys 15, to be contained.

The base 11 overextends the sidewalls 12, 14 as shown and may be provided with a planar region above the side walls, as viewed, for convenience in handling and which may be aperture as at 16 for hanging the container.

A second panel 17 is shown in FIG. 2 in position opposite the panel 10 to cover the enclosure. This panel 17 is formed with pairs of opposed walls 19, 20 structurally similar to the sidewalls 12, 14 to define an enclosure upstanding from a base 2, slightly larger than the enclosure defined by the side walls 12, 14, but I prefer that the walls 19, 20 be closed at the corners, unlike the walls 12, 14 of the first panel 10.

It will be seen that the side walls 12,14 are formed with tabs 22 and that the walls 19, 20 are formed with similar tabs 24, each tab 22 providing a cam surface 25 inclined outwardly and toward the base of the panel 10, and each tab 24 providing a cam surface 26 inclined inwardly and toward the base of the panel 17. The tabs 22 and 24 are also configured to provide locking surfaces 26′ and 27, respectively, which surfaces are preferably planar surfaces parallel to the plane of their respective panel bases.

As shown in FIGS. 5, 6, and 7, the sidewalls 12, 14, walls 19, 20, tabs 22, 24 and associated cam and locking surfaces are so configured and dimensioned that when the panels 10 and 17 are brought together to close the container, the cam surfaces 25 an 26 come into mutual engagement so that the closing force cams the side walls 12, 14 of the panel 10 resiliently inwardly until the respective cam surfaces pass one another, at which point they return to their natural positions thus bringing respective locking surfaces 26′, 27 into engagement to lock the panels against separation.

It will be understood that the sidewalls 12, 14 are allowed to flex during the camming action because the corner sections of these side walls are omitted, but the walls 19, 20 could be similarly constructed instead to permit them to flex or both the side walls 12, 14 and the walls 19, 20 could be so constructed so that both would flex during camming.

The security of the container may be further enhanced by providing an upstanding lip 29 on the base of the panel associated with the interior tab. Thus, in the preferred embodiment and as illustrated in FIGS. 1 to 4, a continuous lip 29 is formed on the base 11 of panel 10 to surround the sidewalls 12, 14 and sufficiently spaced therefrom to allow the tab 24 on the panel 17 to fit between the lip 29 and the side walls 12, 14. By reason of this construction, it will be impossible to insert a tool between the tab 24 and the side walls 12, 14 to flex the tab 24 outwardly to release engagement of the respective locking surfaces and open the container.

From the foregoing description, it will be seen that a container made according to the present invention, once closed, may be opened only by applying substantial force physically to destroy the same, thus giving a clear indication of access to the container contents.

I may provide a roughened surface on the outer surface of one of the panel bases for the indelible reception of identifying indicia such as a code number, fingerprint or the like so that only the owner of the container contents and those he chooses to make privy to the information will be able to identify them as to ownership.

I believe that the construction and application of my novel self-locking container will now be understood and that the advantages thereof will be fully appreciated by those persons skilled in the art.

I claim:

1. A non-reusable self-locking container comprising:

a first panel including side wall means extending from a surface thereof and provided with a tab defining cam means and a locking surface;

a second panel including a wall means extending from a surface thereof and provided with a tab defining cam means and a locking surface;

said sidewall means and said wall means being adapted to be telescopically disposed relatively to one another to close said container, said cam means of said first and second panel tabs engaging one another during telescoping movement of said sidewall means and said wall means resiliently to flex at least one of said sidewall means and said wall means away from the other, said locking surfaces assuming a condition of mutual engagement to permanently lock said panels against separation upon completion of said telescoping movement;

said first and second panels once closed being locked against entry to the container until the permanent and visible destruction of the container.

2. A self-locking container according to claim 1, wherein at least one of said sidewall means and said wall means, is formed of a semi-rigid material.

3. A container according to claim 1, wherein first and second panels are hinged along an axis to bring said tabs into cooperative disposition upon relative movement of said panels to close said container.

4. A self-locking container according to claim 2 wherein said panels are molded of high impact polystryene.

5. A self-locking container according to anyone of claims 1 to 4 wherein said cam means are inclined surfaces formed on said respective tabs for mutual engagement during said telescoping movement to flex at least one of said sidewall means or said wall means away from the other and said locking surfaces are perpendicular to the planes of said sidewall means and said wall means when in locking condition.

6. A self-locking container according to any one of claims 1 to 5, wherein said sidewall means of said first panel is disposed within the confines of said wall means of said second panel when said container is closed and said first panel is formed with an upstanding lip overlapping the distal end of said wall means of said second panel.

7. A self-locking container according to any one of claims 1 to 6, wherein at least one of said panels includes an exterior surface area adapted to receive indicia thereon.

8. A non-reusable self-locking container comprising:

a first panel including a surface, side walls extending generally orthagonally from said surface, and a first cam with a locking surface;

a second panel including a surface, walls extending generally orthagonally from said surface, and a second cam with a locking surface;

said first and second cams being adapted to telescopically engage one another resiliently to flex one away from the other;

said locking surfaces being adapted for mutual engagement to permanently lock said cams in mutual engagement;

said side walls and walls being adapted to protect said cams and locking surfaces from disengagement;

said first and second panels forming an enclosure which is permanently locked against entry upon completion of said telescoping movement, except by the permanent and visible destruction of said container.

9. A self-locking container according to claim 8 wherein said cams comprise tabs with inclined surfaces for mutual engagement during said telescoping movement to flex at least one of said inclined surfaces away from the other and said locking surfaces are perpendicular to the planes of said side walls and said walls.

* * * * *

UNITED STATES PATENT AND TRADEMARK OFFICE

CERTIFICATE OF CORRECTION

PATENT NO. : 4,445,622

DATED : May 1, 1984

INVENTOR(S) : LEONARDO SIDERI

It is certified that error appears in the above-identified patent and that said Letters Patent is hereby corrected as shown below:

IN THE SPECIFICATION:

Column 3, line 18, change "aperture" to --apertured--.

IN THE CLAIMS:

Claim 6, line 2, change "5" to --4--.

Claim 7, line 2, change "6" to --4--.

Please add new claims 10, 11, 12 and 13.

--10. A self-locking container according to Claim 5, wherein said sidewall means of said first panel is disposed within the confines of said wall means of said second panel when said container is closed and said first panel is formed with an upstanding lip overlapping the distal end of said wall means of said second panel.

11. A self-locking container according to Claim 5, wherein at least one of said panels includes an exterior surface area adapted to receive indicia thereon.

UNITED STATES PATENT AND TRADEMARK OFFICE

CERTIFICATE OF CORRECTION

PATENT NO. : 4,445,622 Page 2 of 2

DATED : May 1, 1984

INVENTOR(S) : LEONARDO SIDERI

It is certified that error appears in the above-identified patent and that said Letters Patent is hereby corrected as shown below:

12. A self-locking container according to Claim 6, wherein at least one of said panels includes an exterior surface area adapted to receive indicia thereon.

13. A self-locking container according to Claim 10, wherein at least one of said panels includes an exterior surface area adapted to receive indicia thereon.--

Signed and Sealed this

*Ninth* Day of *April 1985*

[SEAL]

*Attest:*

DONALD J. QUIGG

*Attesting Officer* *Acting Commissioner of Patents and Trademarks*